United States Patent [19]

Freedman

[11] 4,170,082

[45] Oct. 9, 1979

[54] MODULAR CONNECTORS FOR CYLINDRICAL ELEMENTS

[76] Inventor: Calvin Freedman, 4719 Vanalden Ave., Tarzana, Calif. 91356

[21] Appl. No.: 772,836

[22] Filed: Feb. 28, 1977

[51] Int. Cl.[2] ..... A63H 33/10

[52] U.S. Cl. ..... 46/29; 46/30; 206/504; 220/23.4

[58] Field of Search ..... 46/30, 31, 29, 22, 23, 46/24, 25, 26, 28, 16, 17; 428/33; 220/23.4, 23.83, 3.2, 3.94; 206/504; 229/43; D34/15 FF; 285/128, 158

[56] References Cited

U.S. PATENT DOCUMENTS

| | | | |
|---|---|---|---|
| 1,520,705 | 12/1924 | Farmer | 285/158 X |
| 1,771,264 | 7/1930 | Marrits | 206/504 |
| 1,860,833 | 5/1932 | Clayton | 220/3.94 |
| 2,776,521 | 1/1957 | Zimmerman | 46/30 |
| 2,791,868 | 5/1957 | Viken | 46/30 |
| 2,937,038 | 5/1960 | Gondek | 285/158 X |
| 3,310,906 | 3/1967 | Glukes | 46/25 |
| 3,381,844 | 5/1968 | Sieve | 46/24 UX |
| 3,422,564 | 1/1969 | Izumi | 46/22 |
| 3,640,018 | 2/1972 | Light | 46/29 |
| 3,815,281 | 6/1974 | Kander | 46/17 X |
| 3,881,274 | 5/1975 | Kanda | 46/30 X |

FOREIGN PATENT DOCUMENTS

| | | | |
|---|---|---|---|
| 90527 | 12/1922 | Austria | 46/23 |

*Primary Examiner*—Louis G. Mancene
*Assistant Examiner*—Mickey Yu
*Attorney, Agent, or Firm*—Robert Louis Finkel

[57] ABSTRACT

Thin, flat multi-sided plates in various polygonal shapes are provided with a resilient, upstanding annular flange on one or both of their faces to receive the ends of tubular elements, such as beverage cans. Upstanding pins are formed on one face of the plates, near one end of certain of their sides, and laterally-extending tabs having pin-engaging apertures are hingedly attached to the plates by means of thin, flexible webs formed at the opposite ends of the same sides. Preferably, the webs are designed to displace the tabs in the direction of the pin-carrying face so that adjacent plates are in substantial alignment when their corresponding tabs and pins are interlocked.

15 Claims, 14 Drawing Figures

Fig. 5
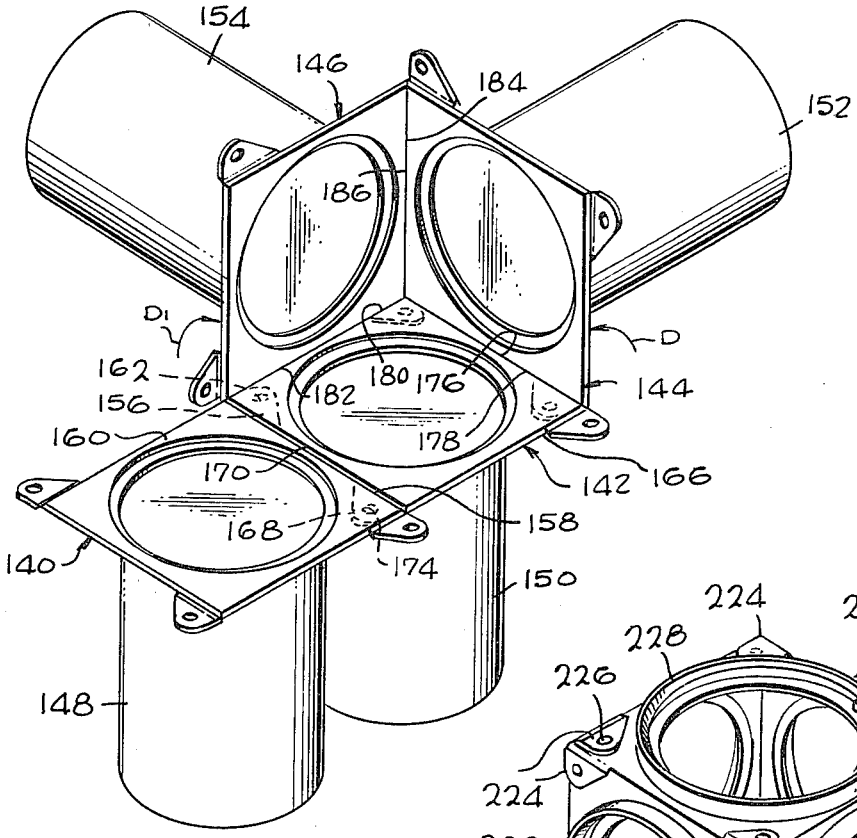
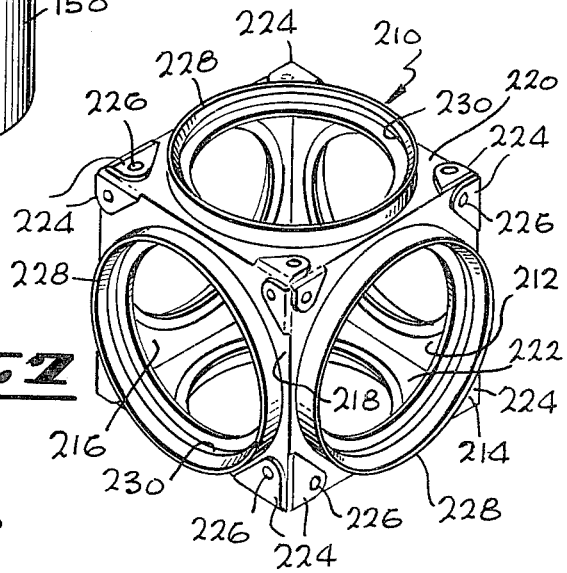
Fig. 7
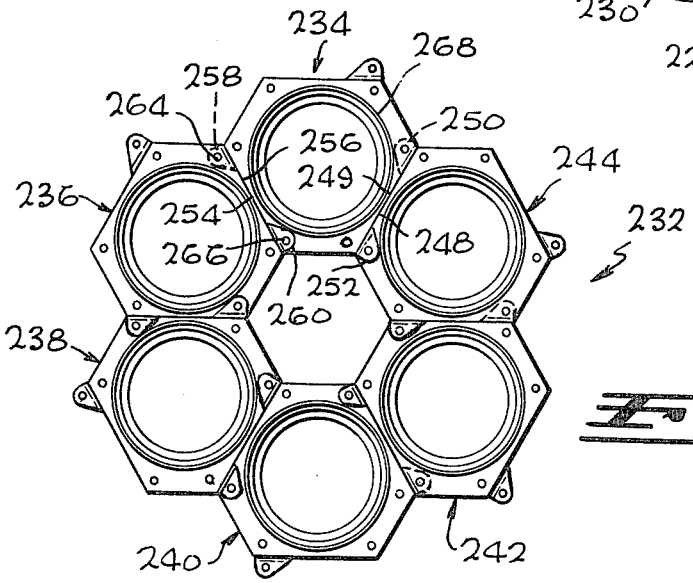
Fig. 8

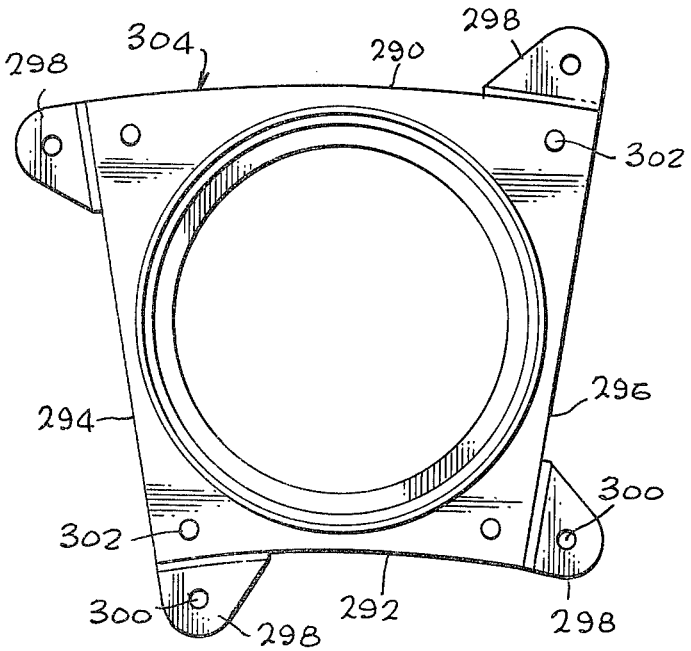
Fig. 11
Fig. 12
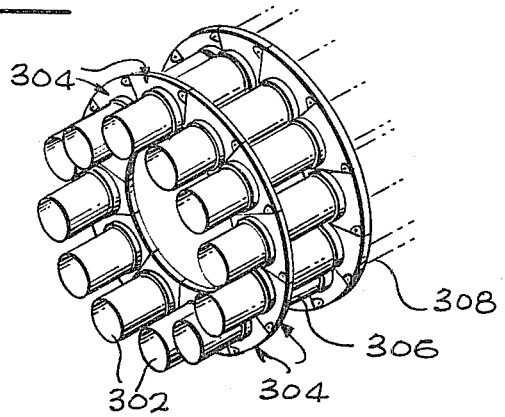
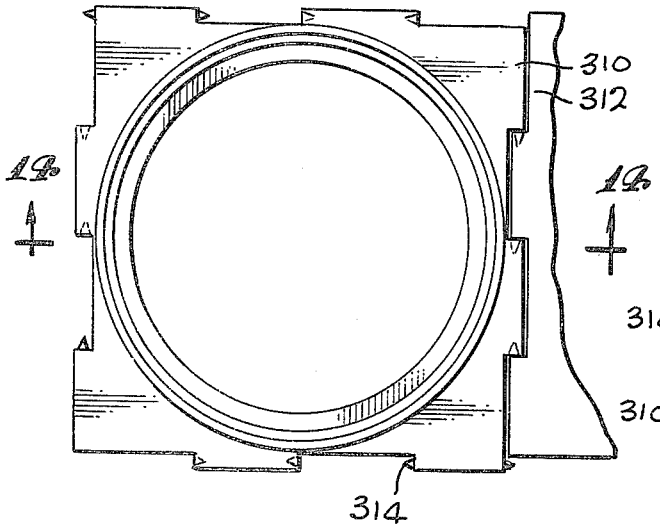
Fig. 13
Fig. 14
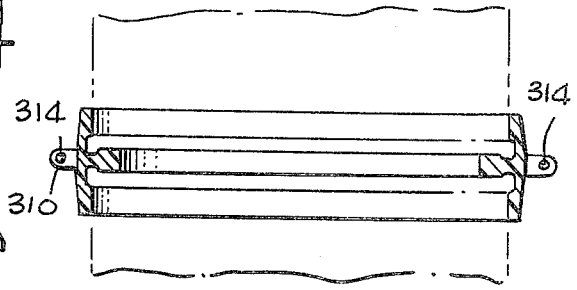

MODULAR CONNECTORS FOR CYLINDRICAL ELEMENTS

BACKGROUND OF THE INVENTION

1. Field of the Invention

This invention relates to a modular connecting device to be used in games or toys and relates, more particularly, to a connector for assembling cylindrical elements, such as metal cans, into an unlimited number of configurations.

The great and continued success of toys and amusement devices consisting of elements by which various objects and structures can be constructed, attests to their vocational, entertainment and therapeutic value. The present invention, along with possessing these qualities, is additionally useful because it utilizes as part of the completed construction metallic containers, such as tin and aluminum cans, which are in widespread common use and are normally discarded after they have served their intended purpose.

2. Prior Art

Already known in the art are devices adapted to detachably interconnect or combine a plurality of cylindrical or annular elements such as, for example, beverage cans. Resilient clips, modular knock-down constructions, and like element assembling structures are widely used as toys or for purposes of storage. Some of these incorporate features for interlocking adjacent tubular elements in various spacial relationships.

One such arrangement, for instance, is disclosed in U.S. Pat. No. 3,640,018 to Stanley Light. This patent teaches a modular structural toy which facilitates the combination of a number of cylindrical members. The toy is in the form of a cubical block which is fitted with annular and cylindrical projections on the faces of the block. The projections are arranged so as to resiliently retain the rimmed ends of the tubular cylindrical elements inserted therein. The projections further facilitate that the cylindrical elements may be branched selectively in one or more directions. The patent further teaches the use of annular adaptors which are employed to compensate for differences in the length of the cylindrical members or cans utilized in the forming of a structural assembly. Light's block is a unitary structure.

Another connecting device for tubular elements is shown in U.S. Pat. No. 3,422,564, to Izumi. This patent teaches the use of a substantially circular module composed of a hollow center portion adapted to receive and retain the end portion of a tubular element. Each module is provided with a series of rigid flange members bounding the center portion and adapted to nest with identical flange members of adjacent similar units.

U.S. Pat. No. 3,421,681 to Frank discloses a cup and lid combination in which the lid tightly sealingly engages the cup so as to substantially interlock with the cup. This patent also teaches the provision of novel means associated with the lid for loosening the engagement between the cup and lid and facilitating removal of the lid from the cup.

Still another connecting device for tubular elements is disclosed in U.S. Pat. No. 3,389,830 to Gordon Smith. This patent shows parallelepipedon containers having non-flaring sides. The containers are integrally provided with complementary tops and bottoms that lock together to facilitate stacking. A clip is provided to laterally interlock the containers for storage or transportation purposes.

Also, U.S. Pat. No. 1,895,611 to Doak, discloses building blocks as educational blocks and as toys. The patent is concerned with a block comprised of a hollow cubical member made of a resilient material and having a plurality of cylindrical recesses disposed within its faces, and a plurality of resilient cylinders adapted to intimately engage with the recesses of a like block, the recesses also being adapted to aid in the detachably securing of the block to a supporting surface.

SUMMARY OF THE INVENTION

The present invention can be briefly described as embodying individual connector modules having varying polygonal contours and which are adapted to secure and combine a plurality of cylindrical elements into a myriad of modular structures.

The invention also contemplates the provision of such polygonal individual connector modules which may be used as educational and amusement devices and which are designed to increase, to a great extent, the number and esthetic quality of design and toy structures to be created.

Also, with a view to ecology, the invention contemplates the use of such polygonal connector modules in combination with tin and aluminum empty beer or other type of beverage cans which normally are considered waste and, quite frequently, are discarded at random places.

The invention further contemplates the provision of such polygonal individual modules which may have utility in the construction industry, e.g., as interconnecting devices for metallic pipe sections.

The invention still further contemplates the provision of a polygonal connector module of this type which is simple and lightweight in construction, is economical to manufacture, and is molded as a single homogeneous element.

Such a connector module for cylindrical elements according to the invention comprises a substantially flat base plate having a circumferential outer polygonal edge defining at least three corner edges at the junctures of the straight sides of the edge; an annular upright projection on one or both sides of the plate, the annular projection defining an inner inwardly directed lip adapted to tightly frictionally engage over the beaded end of a cylindrical element positioned in the projection; and male and female interlocking members in the region of the plate corner sections to facilitate connection of the connector module with one or more adjacent connector modules having a similar or varying outer polygonal circumference, the interlocking members comprising at least one apertured hinged tab member on one of the connector modules adapted to receive a pin member on one of the adjacent connector modules.

Other objects and purposes will appear from the detailed description of the invention following hereinafter, taken in conjunction with the accompanying drawings, wherein:

THE DRAWINGS

FIG. 5 is a perspective view of a plurality of interconnected modular connectors of FIG. 2, illustrating an arrangement in which a plurality of cylindrical elements are secured and combined into a modular construction;

FIG. 7 is a perspective view of a still further modular construction, illustrating a plurality of connectors of FIG. 2 combined into a cubical structure;

FIG. 8 is plan view of yet another modular construction, illustrating a plurality of connectors of FIG. 1 combined into an annular or tunnel structure;

FIG. 11 is a plan view of an alternate embodiment of the connector shown in FIG. 2;

FIG. 12 is a perspective view of a modular construction, illustrating a plurality of connectors of FIG. 11 combined into an annular tunnel structure;

FIG. 13 is a plan view of a modular construction illustrating a plurality of interconnected modular connectors similar to the one shown in FIG. 2, however, incorporating an alternate type of hinge arrangement; and FIG. 14 is a cross-sectional view taken on line 14—14 of FIG. 13.

DESCRIPTION OF THE PREFERRED EMBODIMENTS

Figure 1:
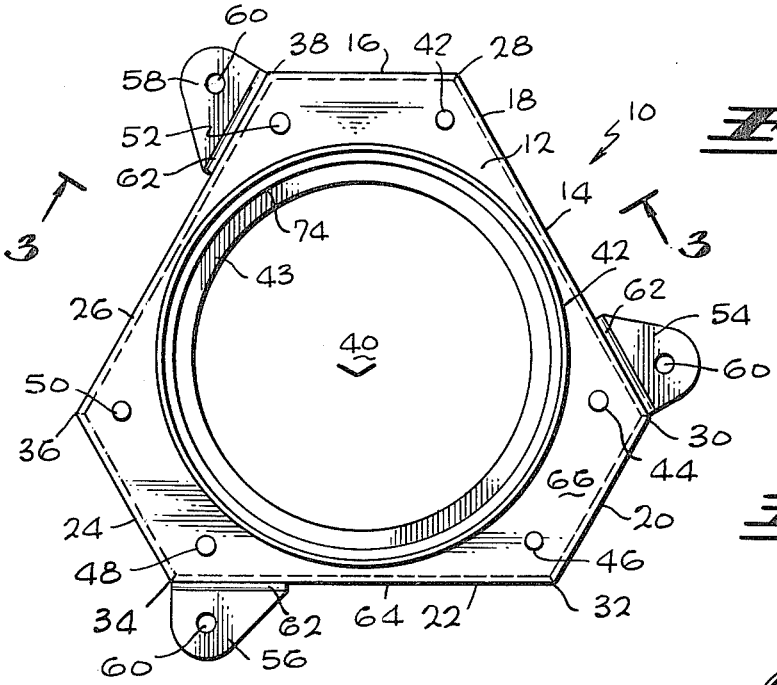
FIG. 1 is a plan view of a modular connector for cylindrical elements according to the invention, illustrating a first embodiment thereof.
Figure 3:
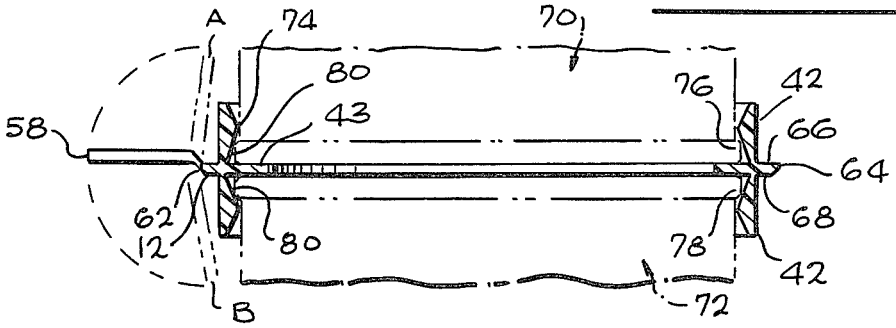
FIG. 3 is a cross-sectional elevational view taken on line 3—3 of FIG. 1.

Referring first to FIGS. 1 and 3 of the drawings, a first typical embodiment of a connector module of the invention is generally designated by the numeral 10. Module 10 is seen to comprise a generally flat base plate 12 which has an outer polygonal circumference of generally triangular shape, defined by a terminal edge 14. Formed at the junctures of the straight sides 16, 18, 20, 22, 24 and 26, are corner sections 28, 30, 32, 34, 36 and 38, respectively. The base plate 12, as shown in FIG. 1, is provided with a central opening 40. The plate is formed with an annular, upwardly directed flange 42 which extended concentrically with opening 40. Flange 42 is spaced radially a slight distance from the inner plage edge or rim portion 43 which bounds opening 40.

Provided in the corner sections 28, 30, 32, 34, 36 and 38 on one or both sides of the plate 12 are outwardly projecting pin members 42, 44, 46, 48, 50 and 52, respectively.

Extending outwardly from the sides 18, 22 and 26, are hinged tab members 54, 56 and 58, respectively. Each of the tab members 54, 56 and 58 has an aperture 60 extending therethrough. Also, each of the tab members includes a hinged portion 62 molded integrally with plate 12 at the corner sections of those sides from which the tab members extend outwardly. Typically, the hinged portions 62 are integral with the extreme, fine edge portion 64 of the plate edge 14. In other words, the hinge portions 62 are extremely thin but highly flexible. As indicated by the arrows A and B in FIG. 3, the hinge portions 62 may be bent or pivoted through an arc in excess of 90° in either direction relative to their normal rest position which lies in the plane of the module.

As shown in FIG. 3, both faces 66, 68 of plate 12 may be formed with a flange 42 so as to enable two cans 70, 72 to be joined by a single connector module 10. To this end, the inner periphery of flanges 42 define an inner inwardly directed rib or lip portion 74 such that the beaded or rimmed ends 76, 78 of the cans 70, 72, respectively, abut plate surface portion 43 and are held in place by the lips 74 which retain the ends 76, 78 of the cans in an annular groove 80, inwardly of the resilient lip 74.

Typically, the module is molded as a single homogeneous element and manufactured from a plastic material such as polyethylene, polypropolene and like plastic materials. It should be noted that where the plate 12 is somewhat stiff and only slightly resilient so as to add to the rigidity of the module, the flanges 42 as well as lips 74 are sufficiently flexible to permit positioning of the beaded end of a can or cylindrical element into the projections.

Figure 2:
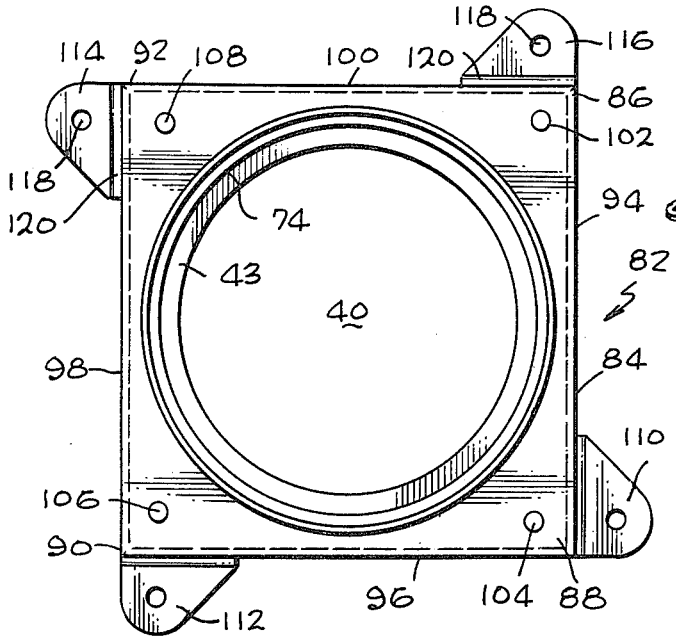
FIG. 2 is a view similar to FIG. 1, but illustrating a second embodiment of a modular connector for cylindrical elements according to the invention.

The module 82 shown in FIG. 2, is seen to have a rectangular outer contour bounded by a terminal edge 84. Corner sections 86, 88, 90 and 92 are defined at the junctures of the straight sides 94, 96, 98 and 100, respectively. Formed integrally within the confines of the corner sections are upstanding pin members 102, 104, 106 and 108. Molded integrally with the sides 94, 96, 98 and 100, are tab members 110, 112, 114 and 116, respectively. Each of the tab members is provided with an aperture 118 and a hinge portion 120. The construction of the hinge portions 120, the flanges 42 and the lips 74 is identical with that of their counterparts in the arrangement of FIGS. 1 and 3.

Figure 4:
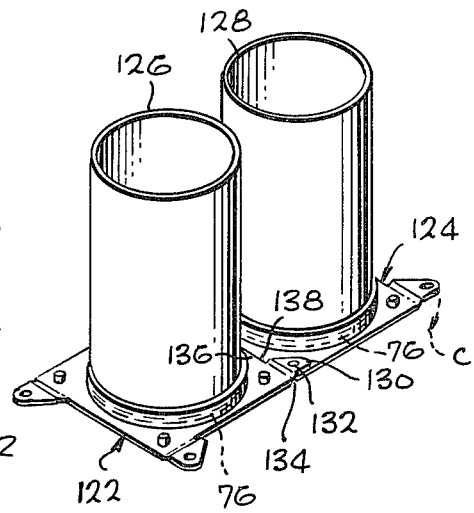
FIG. 4 is a perspective view of two of the modular connectors of FIG. 2 connected together, and illustrating a can joined with each one of the connectors.

FIG. 4 shows a modular construction in which two connector modules 122, 124, which are identical to the connector 82 of FIG. 2, are interconnected and with each of the modules provided with a can 126, 128, respectively. The apertured tab member 130 of module 122, in the arrangement shown, is secured to the associated pin member 132 of module 124 at the corner section 134 thereof. It will be appreciated that at the opposite corner, hidden from view, the apertured tab member of module 124 is positioned over the associated pin member of module 122. In the connected position shown, side 136 of module 124 extends parallel with and closely adjacent side 138 of module 122. Upon such interlocking, and due to the flexibility provided by hinge portion 120 of the tab members, the latter assume a position substantially parallel with the planar surfaces of the interconnected connector modules. The module 124 may be pivoted about the hinges 120 of the tab members from the position shown to the position indicated by the arrow at point C, which in the arrangement shown, is in excess of 90°.

FIG. 5 shows yet another modular construction in which four connector modules 140, 142, 144 and 146, identical to the module 82 of FIG. 2, are interconnected and each provided with a can or cylindrical element 148, 150, 152 and 154, respectively. As shown, apertured tab member 156 extending from the extreme edge 158 of face 160 of module 140 is secured to associated pin member 162 on face 166 at one side of module 142. Similarly, tab member 168 extending from the extreme edge 170 of module 142 is secured to associated pin member 174 of module 140.

Subsequently, each of the other connector modules 144, 146 is connected to the next adjacent module. For example, after module 144 has been connected to module 142, the former is thereupon, pivoted upwardly through 90°, as indicated by arrow D. Module 146 also connected to module 142 is, subsequently, pivoted upwardly through 90°, as indicated by arrow D1. In this manner, the sides 176, 178 of modules 142 and 144, respectively, are interlocked while sides 180, 182 of modules 142 and 146, respectively, are also interconnected. Likewise, sides 184, 186 of modules 144 and 146, respectively, are connected with each other. It should be noted, that module 144 extends at an angle of 90° relative to module 146.

Figure 6:
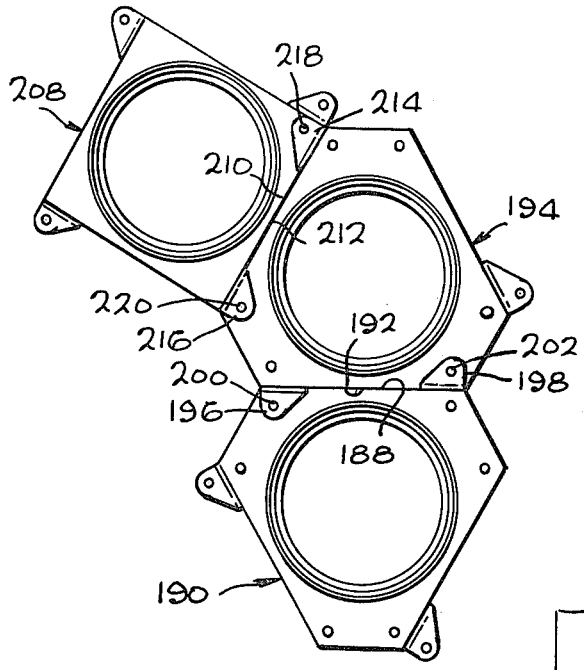
FIG. 6 is a plan view of a further modular construction, illustrating two of the connectors of FIG. 2 interconnected with a connector as shown in FIG. 1.

FIG. 6 shows two interconnected connector modules of FIG. 1, linked to the connector module of FIG. 2. Side 188 of module 190 is secured to side 192 of module 194. Interlocking of these modules, as before, is effected by means of tab members 196, 198 which are secured to associated pin members 200, 202, respectively. Again, as hereinbefore, tab member 196 of module 194 engages pin member 200 of module 190, thereof while tab member 198 extending from the edge 188 of module 190 engages pin member 202 on module 194. Substantially traingular module 194, in this arrangement, is interlocked with module 208 having a rectangular configuration. Both modules 194, 208 include opposing sides 210, 212 provided with tab members 214, 216, respectively, extending therefrom and respectively secured to associated pin members 218, 220. The manner of interconnecting the connector modules 194 and 208 is the same as discussed hereinbefore. It should be noted, that module 208 extends at an angle of approximately 45° relative to module 194.

FIG. 7 shows the interconnection of connector modules of FIG. 2 into a knockdown cubical structure 210. The structure is seen to comprise six modules representing faces 212–222, each interlocked by tab members 224 and pin members 226. In the construction shown, face 212 may initially be connected with face 214 while the former may subsequently be connected with face 216. Subsequently, face 218 is linked onto faces 214 and 216. The four faces, thus interconnected, have the form of a rectangular structure. Thereupon, faces 220 and 222 are connected along their four sides to the faces 212–218. It will be seen, that in this arrangement each of the tab members 224 is bent through an angle of 90° to be secured to the respective associated pin members 226. Each of the six faces is provided with annular projections 228 having inner inwardly directed lip portions 230 formed therein.

FIG. 8 shows an annulus or loop 232 of interconnected connector modules 234–244 each of which is identical to the module shown in FIG. 1. The adjoining interconnected sides 248 and 249 of the modules 234 and 244, for example, are interconnected in the manner as discussed hereinbefore. For illustrative purposes, the tab member 250 of the module 244 extends on the lower side of module 234, as viewed in the drawing, while tab member 252 extends on the upper surface or face of module 244, also as viewed in the drawings. Each of the other adjoining sides of the modules constituting the annulus or loop are interlocked in the similar manner. For example sides 254, 256 of modules 234, 236, respectively, are interconnected by means of tab members 258, 260 which are secured to and engaged over pin members 264 and 266. Each of the modules is provided with the usual annular upwardly directed projection 268 to facilitate the positioning of a cylindrical element onto the connector module.

Figure 10:
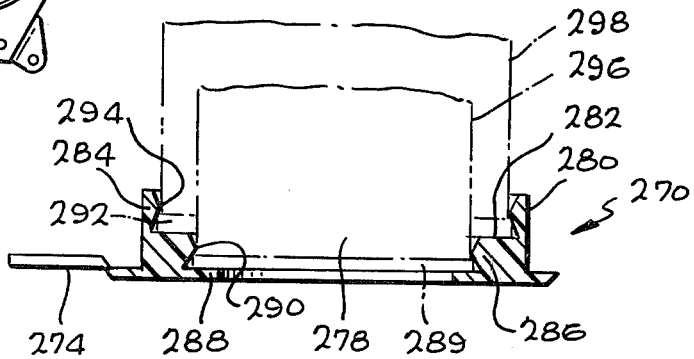
FIG. 10 is a cross-sectional view taken on line 10—10 of FIG. 9.
Figure 9:
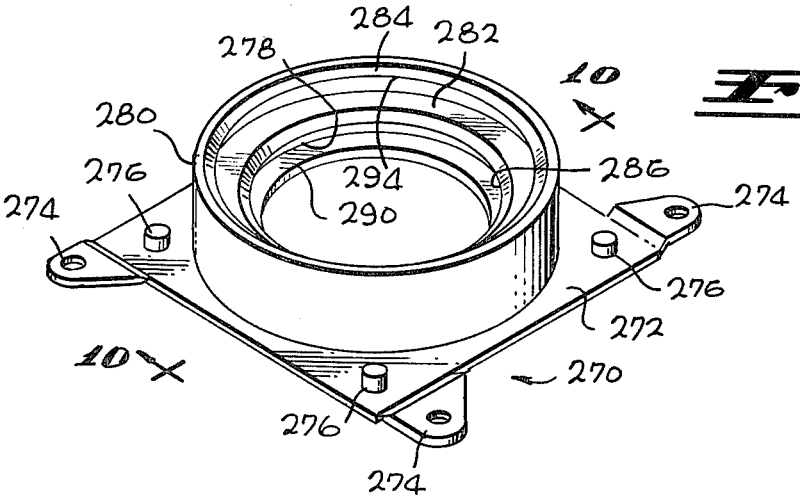
FIG. 9 is a plan view of still another embodiment of a modular connector for cylindrical elements in accordance with the invention.

FIGS. 9 and 10 illustrate a connector module 270 adapted especially for use with cans of varying diameters. The construction of the base plate 272, the tab members 274 and pin members 276 are identical with the ones shown in FIG. 2. The interior 278 of the upwardly oriented projection 280, however, differs from that shown in FIG. 2 in that the interior 278 has a stepped inner circumference. The stepped inner peripheral surface of projection 280 is formed by a shoulder 282 defined between a first widened wall section 284 and a second wall section 286 of a lesser diameter. The shoulder 282, per se, forms an abutment for the end of a cylindrical element or the end of a can which may have a diameter greater than that of the usual standard cans. Such a can having a larger diameter may resiliently be accommodated in the wider section of the projection 280. In case a can having a standard size diameter is to be inserted and retained in the projection 280, such a can will be tightly accommodated within the narrower section 286 of the projection 280, with the rimmed or beaded end of the can engaging plate portion 288 at the bottom of projection 280. This arrangement is clearly illustrated in FIG. 10. As shown, a can 298 having a diameter wider than usual, is inserted into the wider section 284 of the projection 280 and is, at its inner rimmed end 292, engaged by an inner inwardly directed lip portion 294. Also shown is a can having a smaller diameter 296 which is inserted in the narrower portion 286 of the projection. The beaded end 289 of the narrower can is seated behind and retained in place by an inwardly directed inner lip portion 290 provided in the projection at section 286 thereof.

FIG. 11 shows yet another alternate embodiment of a connector module of the invention. Surfaces 290, 292 are arcuate segments concentric about an imaginary center. The sides 294, 296, as shown, are segments of radii passing through the same center. In all other respects, as, for example, the tab members 298, their apertures 300 and pin members 302, the module of FIG. 11 is identical with that shown in FIG. 2.

FIG. 12 shows a tunnel-shaped modular construction in which a multitude of cylindrical elements 302 are adjoined by an annulus of modules 304 of FIG. 11 while a second and third row of elements 306, 308, respectively, are joined and interconnected by a second annulus of interconnected connector modules 304.

FIGS. 13 and 14 show an alternate embodiment of an interlocking hinge arrangement which is in the form of interlocking knuckle hinge members 310 and 312 and which are interconnected by pins 314. The hinge members are attached to the respective opposing side of adjacent connector modules.

With the foregoing in mind, what I claim as my intention is:

1. A connector for use in a construction embodying a plurality of tubular elements fastened together by means of a plurality of such connectors, said connector comprising:

a substantially planar base plate having a peripheral polygonal edge defining a plurality of adjoining sides;

a single attachment member hingedly mounted to, and extending laterally outwardly of certain of said sides, adjacent the corresponding end of each of said certain sides, said attachment member comprising a substantially planar tab having an aperture therein;

connecting means formed on said base plate adjacent the opposite ends of said certain sides, for releasably engaging corresponding attachment members on adjacent ones of said connectors, said connecting means comprising upstanding pins formed on at least one face of said plate in registry with the apertures in said corresponding tabs on adjacent connectors, for insertion into said apertures in releasable frictional engagement therewith; and a resilient upstanding flange on at least one face of said plate, said flange having an inner wall conforming to and adapted to receive and frictionally retain the end of one of said tubular elements.

2. The connector defined by claim 1, wherein said tabs include a flexible resilient transverse hinge portion of reduced thickness, formed integrally with the edge of said base plate, for rotation of said tabs through an arc in excess of 180° relative to the plane of said base plate.

3. The connector defined by claim 2, wherein said tabs are formed to be normally in alignment with said one face of said base plate, whereby the corresponding faces of the base plates of adjacent connectors are substantially co-planar when said tabs and pins are in engagement.

4. The connector defined by claim 3 further comprising retaining means on said flange, for frictionally retaining the end of a tubular element having a bead formed thereon.

5. The connector defined by claim 4, wherein said retaining means comprises a groove formed in the inner wall of said flange, for releasably engaging the said bead upon insertion of the end of said tubular element into said flange.

6. The connector defined by claim 3, having such resilient, upstanding flanges on both faces of said base plate.

7. The connector defined by claim 3, wherein said base plate is generally rectangular in plan.

8. A construction for use in assembling a plurality of tubular elements, comprising in combination a plurality of connectors as defined by claim 7.

9. The connector defined by claim 3, wherein said base plate is generally triangular in plan.

10. A construction for use in assembling a plurality of tubular elements, comprising in combination a plurality of connectors as defined by claim 9.

11. The connector defined by claim 3, wherein said base plate is generally trapezoidal in plan.

12. A construction for use in assembling a plurality of tubular elements, comprising in combination a plurality of connectors as defined by claim 11.

13. In combination, the connector defined by claim 3, with at least one of said tubular elements mounted to said flange thereon.

14. A construction for use in assembling a plurality of tubular elements, comprising in combination a plurality of connectors as defined by claim 3.

15. The construction defined by claim 14, further comprising a plurality of such tubular elements mounted to said connectors.

* * * * *